US006382170B1

(12) United States Patent
Mang et al.

(10) Patent No.: US 6,382,170 B1
(45) Date of Patent: May 7, 2002

(54) METHOD AND DEVICE FOR LUBRICATING AND SIMULTANEOUSLY SUPPLYING FUEL IN COMBUSTION ENGINE

(75) Inventors: Theo Mang, Weinheim; Rolf Luther, Speyer, both of (DE)

(73) Assignee: Fuchs Petrolub AG, Mannheim (DE)

( * ) Notice: Subject to any disclaimer, the term of this patent is extended or adjusted under 35 U.S.C. 154(b) by 0 days.

(21) Appl. No.: 09/530,397

(22) PCT Filed: Oct. 27, 1998

(86) PCT No.: PCT/EP98/06806

§ 371 Date: Aug. 24, 2000

§ 102(e) Date: Aug. 24, 2000

(87) PCT Pub. No.: WO99/23365

PCT Pub. Date: May 14, 1999

(30) Foreign Application Priority Data

Oct. 30, 1997 (DE) ..... 197 47 853

(51) Int. Cl.[7] ..... F01M 9/04
(52) U.S. Cl. ..... 123/196 A
(58) Field of Search ..... 123/196 A, 27 R, 123/27 A, 1 A, 575, 196 S

(56) References Cited

U.S. PATENT DOCUMENTS 4,161,160 A * 7/1979 Hicks et al. ..... 123/1 A
4,440,115 A * 4/1984 Allen ..... 123/1 A
4,495,909 A 1/1985 Hurner
4,557,221 A * 12/1985 Kamel et al. ..... 123/1 A
5,372,219 A * 12/1994 Peralta ..... 123/196 S

FOREIGN PATENT DOCUMENTS

| | | |
|---|---|---|
| DE | 39 06 759 | 6/1990 |
| DE | 43 25 194 | 2/1995 |
| DE | 44 21 448 | 1/1996 |
| EP | 0 793 005 | 9/1997 |
| FR | 1079434 | 11/1954 |
| FR | 2 373 678 | 7/1978 |
| JP | 2000329008 A * | 11/2000 |

* cited by examiner

*Primary Examiner*—Marguerite McMahon
*Assistant Examiner*—Hyder Ali
(74) *Attorney, Agent, or Firm*—Wenderoth, Lind & Ponack, L.L.P.

(57) ABSTRACT

A method and a device for the lubrication, and for the simultaneous fuel supply, of an internal combustion engine are described. To an internal combustion engine during its continuous operation an additive-treated vegetable oil is supplied as a lubricant. The used vegetable oil lubricant, together with a mixture of fresh vegetable oil and Diesel oil or rape seed oil methyl ester is combusted in doses in the engine as engine fuel.

27 Claims, 2 Drawing Sheets

METHOD AND DEVICE FOR LUBRICATING AND SIMULTANEOUSLY SUPPLYING FUEL IN COMBUSTION ENGINE

BACKGROUND OF THE INVENTION

This invention pertains to a method for the lubrication and simultaneous fuel supply of an internal combustion engine, in which the internal combustion engine is operated with a mixture comprising used vegetable oil lubricant, fresh vegetable oil and Diesel fuel or rape seed oil methyl ester. This invention further pertains to an internal combustion engine which is equipped with a container for the dosed supply of fresh vegetable oil into an engine pan from which exhausted vegetable oil is conducted in doses into a fuel tank and, mixed with fuel, and is then supplied to the engine for combustion.

For the lubrication and fuel supply of internal combustion engines, which operate with spark ignition or with compression ignition, currently still petroleum oils are predominantly used. However, partially or fully synthetic lubricants are also already used which, through the addition of additives, acquire the requisite complex properties desired for technical applications. It is known that the lubrication oil must be changed at specific time intervals because, during operation, active substances are consumed, the basic material ages and the lubricant is contaminated with foreign substances. During the oil change, old oils accumulate which represent a considerable environmental problem. Their disposal entails complicated and expensive ways. In order to avoid the accumulation of old oil, it has already been proposed to recirculate the exhausted lubrication oil into the fuel tank and to combust it in the engine together with the fuel.

DE 31 38 144 A1 discloses a lubricant and fuel cyclic course in particular for Diesel engines of heavy duty trucks in which periodically a given quantity of lubrication oil is extracted from the oil pan of the engine and placed into the fuel tank, such that the extracted quantity is consumed together with the customary Diesel fuel. In addition, an automatically operating configuration for monitoring the level of the lubrication oil is provided in order to maintain the lubrication oil level in the oil pan at a nominal level such that fresh lubrication oil is continuously introduced into the lubricant cyclic course, and simultaneously therewith a periodic purification of the old oil occurs. Hereby the waiting times which are required for an oil change are intended to be decreased, and the lubrication oil is, nevertheless, kept substantially clean and in a fresh condition. By adding continuously fresh lubrication oil, the fraction of additives in the lubrication oil is to be kept at a desired value. Thus, only an oil change, which customarily takes place at intervals, is avoided. A specific quantity of exhausted oil is continuously withdrawn from the lubrication system and a corresponding quantity of fresh oil is continuously introduced into the lubrication system.

DE-OS 30 19 877 a device for changing oil in a fuel-burning engine having an internal combustion with a lubrication system including an oil pan and a fuel system including a fuel tank is known in which, for the self-acting oil change and removal of the exhausted oil, an oil transport system is provided. The oil transport system is for transferring a portion of the exhausted engine oil from the lubrication system to the fuel system in order to mix the exhausted oil portion with the fuel. An oil tank for storing fresh oil is provided and an oil feeding system for supplying fresh oil from the oil tank to the lubrication system is provided. The oil transport system can comprise an oil line whose one end communicates with the lubrication system and whose other end communicates with the fuel system, as well as a valve in the oil line. The oil feeding system can comprise an oil feed line, whose one end is connected with the oil tank and whose other end is connected with the oil pan, and a valve interconnected in this oil feed line. This is intended to solve the task of providing a method and a device for changing oil in a fuel-burning engine, in which exhausted oil does not need to be processed again and oil is changed and exhausted oil is removed automatically.

DE 30 06 903 A1 discloses a method for replacing lubrication oil that has collected in the oil sump of a fuel-burning engine, with the aid of an oil suction pump to be controlled separately. At least the quantity of fresh oil corresponding to the quantity of oil siphoned off is supplied to the fuel-burning engine, in which the oil suction pump mixes dosed quantities of oil from the oil sump of the fuel-burning engine with the fuel of the fuel-burning engine. The quantities of oil are chosen such that, independently of the oil consumption of the fuel-burning engine, within an oil change interval the prescribed oil filling quantity is siphoned off. Further, a device is proposed for carrying out this method. The device comprises a fuel-burning engine with an oil sump in which a constant tankage of lubrication oil is provided, and a separate oil suction pump connected with the oil sump of the fuel-burning engine on its suction side, whereby quantities of oil dosed by the oil suction pump can be removed from the oil sump of the fuel-burning engine and can be supplied to the fuel of the fuel-burning engine. Hereby necessary oil changes are said to be superfluous. The lubrication oil quantity is chosen such that the oil filling quantity is siphoned off independently of the oil consumption of the fuel-burning engine within the oil change intervals specified by the engine manufacturer for the engine type. A control instrument is provided such that only in the case of a fuel filling process, in which a level indicator moves upwardly within a short time, the oil suction pump starts to operate. Simultaneously therewith, lubrication oil and fuel are filled into a fuel tankage container such that good thorough mixing is ensured.

In all engine lubrications provided so far it is of a disadvantage in that, due to the use of petroleum oils, the environment is harmed in an unsatisfactory manner and no measures are provided for adding exhausted oil to the fuel system in dosed quantities.

A method and a device for lubricating an internal combustion engine is also known from the German Patent 39 06 759, in which to the lubrication content of the internal combustion engine during operation fresh lubricant is repeatedly supplied from a fresh oil tank. And, simultaneously therewith to the lubricant content of the internal combustion engine at least partially aged lubricant is repeatedly withdrawn and mixed in doses with the engine fuel for combustion. As a lubricant therein, essentially is used a natural vegetable oil, for example rape seed oil. The at least partially aged oil drawn off via a dosing pump, is subsequently supplied under control to the fuel tank of the internal combustion engine according to the amount of the engine fuel such that a predetermined concentration of the vegetable oil is not exceeded.

In this type of loss lubrication of an internal combustion engine, the finding is utilized that, to the fuel of an internal combustion engine with spark ignition or compression ignition, oil can be added up to a few percent without impairing the engine performance, which oil subsequently is combusted during the fuel combustion. Thereby, on the one hand, to the internal combustion engine during its operation fresh oil is supplied continuously according to the invention, but, on the other hand, the partially aged oil is also continuously withdrawn. Thus, a sufficient tankage of fresh lubrication oil is continuously available for lubrication. Even in the form of exhausted oil, which is supplied to the fuel only in a limited and precisely controlled extent and combusted with it, the natural vegetable oils used herein do not yield any combustion products that are damaging to the environment. Prerequisites for the joint combustion of the exhausted vegetable oil and fuel are control and regulation instruments which control precisely the quantities of vegetable oil drawn out of the oil pan and supplied to the fuel.

There have also been considerations given to employing vegetable oils as fuel in Diesel engines. For this purpose, the methyl esters of natural oils, for example the rape seed methyl ester, have been initially in the forefront of interest. This is so because, since conventional Diesel engines only need to be modified insignificantly, attention subsequently turned to the chemically unaltered natural vegetable oils, which as renewable raw materials that are compatible with the environment, can be used in particular for utility vehicles in the fields of agriculture and forestry as alternatives to petroleum oil products. Therefore a "Vorläufiger Qualitätsstandard für Rapsöl als Kraftstoff (preliminary quality standard for rape seed oil as fuel)" has already been worked out by the team "Dezentrale Pflanzenölgewinnung Weihenstephan" (decentral vegetable oil production Weihenstephan).

SUMMARY OF THE INVENTION

The present invention is based on the concept that not only are relatively small quantities of used vegetable oil lubricant removed from the engine pan supplied together with Diesel oil or rape seed oil methyl ester for combustion but, moreover, that relatively large quantities of fresh nonadditive-treated vegetable oil are specifically added to the fuel, which relatively large quantities substitute for corresponding quantities of Diesel fuel.

Subject matter of the instant invention includes a method for the lubrication and simultaneous fuel supply of an internal combustion engine in which, from a container for a vegetable oil, a portion of the fresh vegetable oil is removed in doses, which, after being mixed with additives supplied from a container, is used as a lubricant. Another portion of the fresh vegetable oil is removed from the container for a vegetable oil, and together with the exhausted vegetable oil drawn from an oil pan via an oil line, and the Diesel oil or rape seed oil methyl ester, supplied from a fuel tank, is combusted in the internal combustion engine as fuel.

DETAILED DESCRIPTION OF THE PREFERRED EMBODIMENTS

Figure 1:
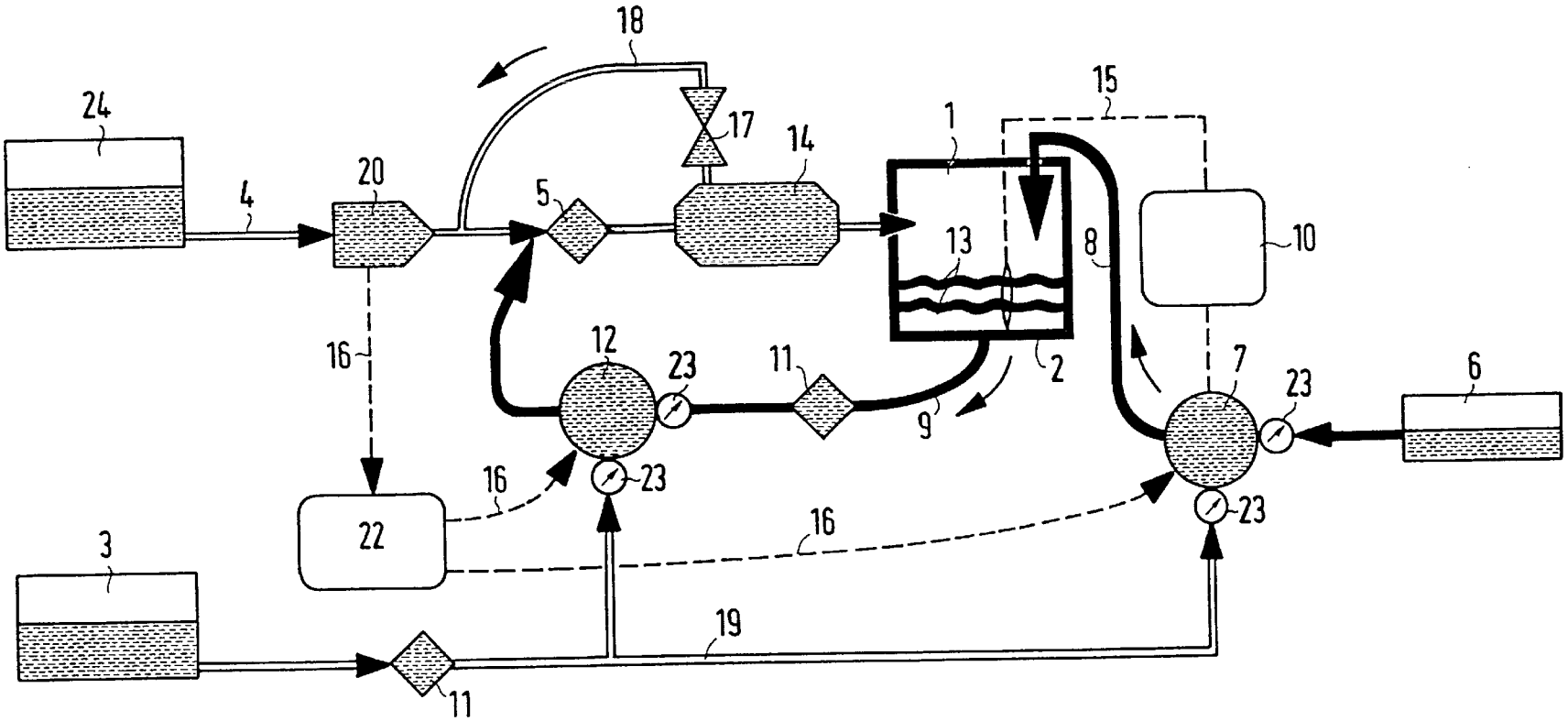
FIG. 1 is a schematic depiction of the invention.

As shown in FIG. 1, an internal combustion engine 1 is supplied via a fuel line 19 by virtue of a fresh oil pump 7 that is equipped with a mixing instrument. Precise doses of an additive concentrate from container 6 are also supplied via the fresh oil line 8. A requisite quantity of a natural vegetable oil, such as rape seed oil is provided for lubrication. The mixing ratio of additive concentrate to base oil can be between 10:90 and 40:60; however, in general a ratio of approximately 25:75 is selected. In the oil pan 2 of the engine 1, a specific level of the engine oil 13 is maintained by virtue of an oil level control 10. The oil pump 7 receives from the oil level control 10, via a control line 15, a start signal if the oil level in the oil pan 2 has fallen below a predetermined value.

When the nominal level is reached, the fresh oil pump 7 is switched off again. In this way the vegetable oil 13 in the oil pan 2 is repeatedly supplemented by fresh oil from the container 3. Within the oil pan 2 is disposed an oil pump (not shown) which ensures the lubrication of the internal combustion engine 1 with the aid of the vegetable oil 13.

From the bottom region of oil pan 2 branches off a used oil line 9 through which the used vegetable oil is drawn off by an oil pump 12 equipped with a mixing instrument. In the oil pump 12 the used vegetable oil is mixed with fresh nonadditive-treated vegetable oil which is supplied from the container 3 via an oil filter 11. The fraction of fresh vegetable oil is precisely predetermined and controlled via a throughflow quantity meter 23. The resulting mixture is transported into the fuel line 4 where it is added to the Diesel oil or rape seed oil methyl ester pumped from tank 24. The fuel mixture now comprising three components is transferred via the fuel filter 5 to the fuel pump 14, and from there to the engine 1. Because of the fuel return line present in Diesel engines, in which the fuel pump delivers considerably more than the engine consumes, in order to avoid used oil accumulations in the tank, the return line 18 must be directly connected to the fuel line 4. The functions of the dual line system, i.e. cooling and ventilation of the fuel, can also be assumed by other known ventilation systems, if necessary.

In the method according to the invention, the exhausted vegetable oil which already has served for engine lubrication, as well as fresh vegetable oil is mixed with the Diesel oil or the rape seed oil methyl ester, and together with it combusted in the engine.

The method according to the invention has the special advantage that a flexible change between differing types of fuels is possible. However, total quantity of the vegetable oils contained in the fuel, comprising the vegetable oil drawn from the oil pan 2 and that removed from the container 3, should consist of less than 100% of the fuel. This is a special advantage for the cold start of engines when Diesel fuel is required in the start phase.

The method according to the invention can be carried out with many conventional Diesel engines if the sum of the vegetable oil additions does not exceed a quantity of 5 percent by weight. 2% of this quantity should comprise used vegetable oil lubricant and 3% fresh, nonadditive-treated vegetable oil. The remaining 95% is, for example, Diesel oil. It is understood that the engine can also be operated "intermittently", i.e. it can on occasion also be operated exclusively with Diesel fuel. However, if the engine is intended to run exclusively with vegetable oil, a special vegetable oil-rated engine must be used.

As vegetable oils used, for example, are rape seed oil, soy bean oil, sunflower oil or palm oil, to which, for lubrication function, have been added small quantities of highly effective additives comprising antioxidants, wear protection additives, detergents and dispersion agents. The continuous replenishing of the lubricant permits a lower dose of the particular additives than that associated with conventional circulating lubricants, whereby the effect on the environment is minimized. Preferably, a concentrate of the additives in the vegetable oil is initially prepared and this concentrate is subsequently added in specific quantities to the vegetable oil.

The addition of additives to the vegetable oil is important since nonadditive-treated vegetable oil could only lubricate an engine for a short time without causing permanent damage. As additives, small quantities of highly effective antioxidants, wear additives, detergents and dispersion agents are added. The ash-forming components of the additives do not comprise any zinc, and the sum of these ash-forming components, e.g. oxide ash, is less than 0.5 percent by weight. It is also important that the vegetable oil for engine lubrication only be used according to the replenishing method according to the invention, since otherwise engine damage could result. On the other hand, it must be emphasized that the method according to the invention cannot be operated with a conventional additive-treated petroleum engine oil since this engine oil customarily comprises heavy metal-containing additives which are released during the combustion of the oil and then damage the environment. A further advantage of the method according to the invention is that the used lubrication oil containing phenolic and/or aminic additives, after being mixed with the vegetable fuel, exhibits a stabilizing effect.

Subject matter of the instant invention also pertains to an internal combustion engine with which the method according to the invention can be carried out. This engine, shown schematically in FIG. 1, is equipped with one container 3 for fresh vegetable oil, another container 6 for an additive concentrate, and yet another container 24 for Diesel oil or rape seed oil methyl ester. The container 6 containing the additive concentrate is connected with an oil pump 7 which includes a mixing valve, in which mixing valve and pump 7 the fresh vegetable oil, branched off from tank 3, can be mixed with the additive concentrate and subsequently supplied via the fresh oil line 8 to the engine 1 as an engine lubricant.

The internal combustion engine also includes a used oil line 9 through which the used vegetable oil drawn from the oil pan 2 of the engine 1 is supplied to an oil pump 12. The pump 12 is provided with a mixing instrument, and in the mixing instrument and the pump 12 the used vegetable oil is mixed with fresh vegetable oil and Diesel fuel or rape seed oil methyl ester, which mixture is subsequently supplied to the injection pump 14. The mixture is combusted as a fuel in the internal combustion engine.

This configuration ensures that the oil pump 7 and its mixing instrument are connected through a control line 16 with the oil pump 12 and its mixing instrument, as well as with the throughflow quantity meter 20 via the electronic control 22. This ensures that the quantity of fresh vegetable oil delivered by the fresh oil pump 7 is determined such that the oil level in the oil pan 2 always remains at approximately the same level (load-dependent vegetable oil component). The quantity of used oil removed from the oil pan 2 by the oil pump 12 is compensated for by fresh vegetable oil which is supplied to the engine 1 via oil line 8. The electronic control 22 is set such that the quantity of vegetable oil supplied to the engine 1 is controlled according to the fuel consumption. A potential discrepancy of the oil level from the nominal value is detected by the oil level control 10, and is compensated for by the oil pump 7.

Figure 2:
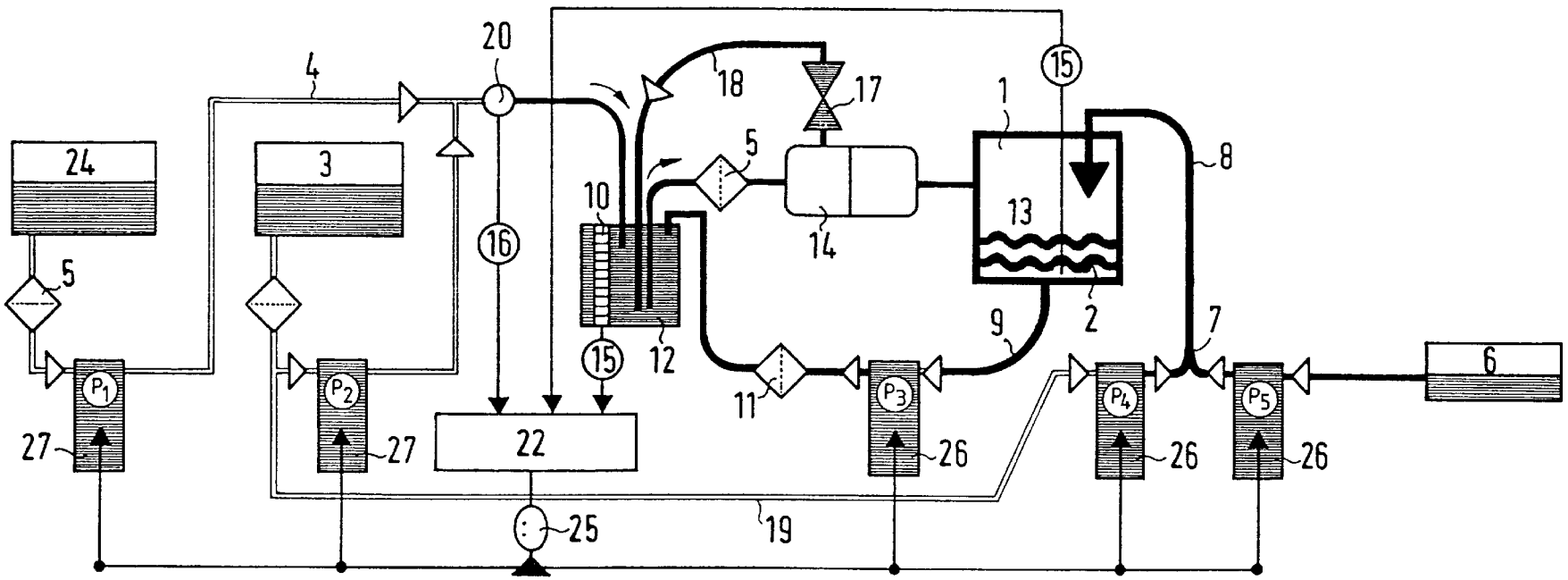
FIG. 2 is a further schematic depiction of the invention.

The internal combustion engine depicted in FIG. 2 shows an especially advantageous structure. A pump $P_1$ for the Diesel fuel, a pump $P_2$ for the vegetable oil, as well as dosing pumps $P_3$, $P_4$, and $P_5$ are provided. All of these pumps are driven by a pump motor 25 whose output is regulated by an electronic control 22. The fuel supplied by pumps $P_1$ and $P_2$ into the mixing container 12 is regulated such that the supply of the Diesel fuel and of the rape seed methyl ester to the vegetable oil is controlled according to fuel consumption. For this purpose, the use of a pressure sensor in the mixing container 12 has proven to be especially useful, which pressure sensor outputs a proportional control signal to the pump motor 25, whereby, depending on the fuel requirement, the Diesel fuel pump $P_1$ performs a quantity control operation. Pump $P_2$ is intended to pump fresh vegetable oil into the fuel line 4 in order to increase the quantity of vegetable oil available for combustion in the mixing instrument 12. It is understood that by switching off the pump $P_2$ the engine can also be operated such that no fresh vegetable oil is supplied for combustion in the engine, and it is also possible conversely, to switch to a pure vegetable oil operation by switching off pump $P_1$, should the engine be suitable for this purpose.

A particularly reasonable and simple method for replenishing the vegetable oil lubricant in the engine is attained through the coordination of the dosing pumps $P_3$, $P_4$ and $P_5$, which are operated synchronously by the pump motor 25 and can be adjusted such that the same quantities of additive-treated fresh vegetable oil are always introduced into the engine and the same quantities of used vegetable oil are always removed from the engine (so-called oil replenishment). The additive-treated fresh vegetable oil is adjusted through the coordination of the dosing pumps $P_4$ and $P_5$, in the oil line 8, which includes a mixing instrument 7. Thus, it is possible to ensure, without complicated and expensive electronic sensors through the symmetrical setting of the dosing pumps that the engine is fixedly set to a mean oil loading and that it operates regulation-free. The oil level in the engine can in this case be monitored as usual and, if necessary, also be replenished.

With this multi-pump system, without complicated and expensive electronic sensors, through the symmetrical setting of the dosing pumps $P_4$ and $P_5$, on the one hand, and $P_3$, on the other hand, it is possible to ensure that the oil level remains largely constant. For compensation of the oil consumption by the engine itself, the oil level in the engine is monitored occasionally and, if necessary, also corrected. The replenishment proportion of this pumping system is determined by the fuel consumption, i.e. the absolute replenishment is proportional to the fuel consumption.

The method according to the invention and the internal combustion engine developed for it can be applied in various ways. It is evident that they are used in particular for utility vehicles in the field of agriculture and forestry, since in these fields the vegetable oils required according to the invention are most readily available. A special advantage; however, is also evident in the operation of block heating and power stations, for which the automated and continuous oil change according to the invention is of utmost importance. The previous customary oil change intervals of 300 to 500 operating hours was considered unavoidable, and when using rape seed oil methyl ester these intervals could be even shorter. These operation interruptions, lead to considerable costs. However, if, with application of the method according to the invention, an oil change is no longer required, the block heating and power station can run continuously, which leads to considerable savings of operating costs and significant improvement of the economy of such heating and power stations.

LIST OF REFERENCES SYMBOLS

1. Internal combustion engine
2. Oil pan
3. Container for vegetable oil fuel

4. Fuel line
5. Fuel filter I (fine)
6. Container for additive concentrate
7. Mixing instrument with oil pump
8. Oil Line
9. Oil line
10. Oil level control
11. Fuel filter II (coarse)
12. Mixing instrument with oil pump
13. Lubricant (vegetable oil)
14. Fuel pump (injection pump)
15. Control line for oil level
16. Control line for pumps
17. Overflow valve (fuel pump)
18. Fuel return line
19. Fuel for lubricant base oil
20. Throughflow quantity meter for fuel
22. Electronic control
23. Throughflow quantity meter for mixing valve
24. Container for Diesel oil or rape seed methyl ester
25. Pump motor
26. Dosing pumps
27. Fuel pumps

What is claimed is:

1. A method for lubrication of and simultaneous supply of fuel to an internal combustion engine, comprising:

removing a first portion of fresh vegetable oil from a first container;

mixing said first portion of fresh vegetable oil with an additive supplied from a second container to thereby provide an additive-treated vegetable oil;

supplying to an internal combustion engine as a lubricant said additive-treated vegetable oil;

removing a second portion of said fresh vegetable oil form said first container; and combusting in said internal combustion engine a fuel including a mixture of said additive-treated vegetable oil that is discharged from an oil pan of said internal combustion engine via an oil line as used additive-treated vegetable oil, said second portion of said fresh vegetable oil, and one of Diesel oil and rape seed methyl ester supplied from a fuel tank.

2. The method according to claim 1, wherein the removing of a first portion of fresh vegetable oil from a first container includes removing a first portion of at least one of rape seed oil, soybean oil, sunflower oil and palm oil from said first container, and the removing of a second portion of said fresh vegetable oil from said first container includes removing a second portion of at least one of rape seed oil, soybean oil, sunflower oil and palm oil from said first container.

3. The method according to claim 2, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of between 1% and 10% by weight of said mixture said used additive-treated vegetable oil, said second portion of said fresh vegetable oil, and said one of Diesel oil and rape seed methyl ester.

4. The method according to claim 2, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of up to 2% by weight of said mixture said used additive-treated vegetable oil, said second portion of said fresh vegetable oil, and said one of Diesel oil and rape seed methyl ester.

5. The method according to claim 4, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

6. The method according to claim 3, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

7. The method according to claim 2, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

8. The method according to claim 2, further comprising controlling a quantity of said additive-treated vegetable oil that is supplied to said internal combustion engine as a function of a quantity of said used additive-treated vegetable oil.

9. The method according to claim 8, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of between 1% and 10% by weight of said mixture said used additive-treated vegetable oil, said second portion of said fresh vegetable oil, and said one of Diesel oil and rape seed methyl ester.

10. The method according to claim 8, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of up to 2% by weight of said mixture said used additive-treated vegetable oil, said second portion of said fresh vegetable oil, and said one of Diesel oil and rape seed methyl ester.

11. The method according to claim 8, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said of Diesel oil and rape seed methyl ester, with the total amount of said used additive-treated vegetable oil and said second portion of said fresh vegetable oil being up to 5% by weight of said mixture.

12. The method according to claim 1, further comprising controlling a quantity of said additive-treated vegetable oil that is supplied to said internal combustion engine as a function of a quantity of said used additive-treated vegetable oil.

13. The method according to claim 12, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of between 1% and 10% by weight of said mixture said used additive-treated vegetable oil, said second portion of said fresh vegetable oil, and said one of Diesel oil and rape seed methyl ester.

14. The method according to claim 12, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of up to 2% by weight of said mixture said used additive-treated vegetable oil, said second portion of said fresh vegetable oil, and said one of Diesel oil and rape seed methyl ester.

15. The method according to claim 12, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

16. The method according to claim 1, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of between 1% and 10% by weight of said mixture said used additive-treated vegetable oil, said second portion of said fresh vegetable oil, and said one of Diesel oil and rape seed methyl ester.

17. The method according to claim 1, wherein the combusting in said internal combustion engine of a fuel including a mixture of used additive-treated vegetable oil, said second portion of said fresh vegetable oil, and one of Diesel oil and rape seed methyl ester includes supplying to said internal combustion engine a fuel including a mixture of up to 2% by weight of said mixture said used additive-treated vegetable oil, said second portion of said fresh vegetable oil, and said one of Diesel oil and rape seed methyl ester.

18. The method according to claim 17, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

19. The method according to claim 16, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

20. The method according to claim 1, wherein said internal combustion engine is a Diesel engine, and wherein the combusting in said internal combustion engine of a fuel including a mixture of used additive-treated vegetable oil, said second portion of said fresh vegetable oil, and one of Diesel oil and rape seed methyl ester includes supplying to said Diesel engine a fuel including a mixture of said used additive-treated vegetable oil, said second portion of said fresh vegetable oil, and said one of Diesel oil and rape seed methyl ester, with the total amount of said used additive-treated vegetable oil and said second portion of said fresh vegetable oil being up to 5% by weight of said mixture.

21. The method according to claim 1, wherein said internal combustion engine is part of a block heating and power station.

22. The method according to claim 1, further comprising adding said additive to said fuel by mixing said additive with said used additive-treated vegetable oil.

23. An internal combustion engine system comprising:

an internal combustion engine having an oil pan;

a supply line;

a first container for containing fresh vegetable oil;

a second container for containing an additive concentrate;

a third container for containing one of Diesel oil and rape seed oil methyl ester;

a mixing device for mixing an additive concentrate supplied from said second container with fresh oil supplied from said first container;

a pump for supplying, as a lubricant, a mixture of the additive concentrate and the fresh oil to said internal combustion engine via said supply line; and a discharge line for removing from said oil pan, as a used mixture, a mixture of the additive concentrate and the fresh oil that was supplied to said internal combustion engine via said supply line, whereby the used mixture can be mixed with the Diesel oil and rape seed oil methyl ester and then supplied to said internal combustion engine.

24. The internal combustion engine system according to claim 23, further comprising pumps to be driven synchronously by a motor for supplying a quantity of the mixture of the additive concentrate and the fresh oil to said internal combustion engine via said supply line and removing a quantity of the used mixture from said oil pan via said discharge line, whereby the quantity of the mixture of the additive concentrate and the fresh oil supplied to said internal combustion engine via said supply line is made equal to the quantity of the used mixture removed from said oil pan via said discharge line.

25. The internal combustion engine system according to claim 23, further comprising an electronic control for controlling a quantity of the Diesel oil or the rape seed oil methyl ester supplied to the used mixture as a function of fuel consumption.

26. The internal combustion engine system according to claim 23, further comprising a mixing device for mixing the used mixture with fresh vegetable oil and the Diesel oil or the rape seed oil methyl ester, and a pump for supplying the mixture of the used mixture, fresh vegetable oil, and the Diesel oil or the rape seed oil methyl ester to an injection pump from which the mixture can be supplied into said internal combustion engine.

27. The internal combustion engine system according to claim 23, further comprising a throughflow quantity meter for controlling, via an electronic control, a quantity of the fresh vegetable oil contained in the fuel that is supplied to said internal combustion engine.

* * * * *